US010696070B2

(12) United States Patent
Teh et al.

(10) Patent No.: US 10,696,070 B2
(45) Date of Patent: Jun. 30, 2020

(54) PRINT UNIT AND PRINTER

(71) Applicant: TOSHIBA TEC KABUSHIKI KAISHA, Tokyo (JP)

(72) Inventors: Jian Qi Teh, Singapore Singapore (MY); Min Wai Khaing, Singapore Singapore (MM); Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/258,847

(22) Filed: Jan. 28, 2019

(65) Prior Publication Data

US 2019/0152240 A1 May 23, 2019

Related U.S. Application Data

(63) Continuation of application No. 15/684,720, filed on Aug. 23, 2017.

(51) Int. Cl.
*B41J 11/00* (2006.01)
*B41J 15/16* (2006.01)

(52) U.S. Cl.
CPC ..... *B41J 11/0045* (2013.01); *B41J 15/165* (2013.01)

(58) Field of Classification Search
None
See application file for complete search history.

(56) References Cited

U.S. PATENT DOCUMENTS

2009/0255971 A1* 10/2009 Nakamaki ..... B41J 11/42 226/1
2012/0228817 A1 9/2012 Kobayashi et al.

FOREIGN PATENT DOCUMENTS

JP H09234924 A 9/1997

* cited by examiner

*Primary Examiner* — Alejandro Valencia
(74) *Attorney, Agent, or Firm* — Kim & Stewart LLP

(57) ABSTRACT

A print unit is disposed in an apparatus having a printing function. The print unit includes a print engine configured to perform printing on a continuous sheet, and a damper located on an upstream side of a sheet entrance of the print engine in a sheet traveling direction and configured to adjust tension applied to the continuous sheet to be fed to the print engine. The damper includes a sheet guide having a planar guide portion which guides the continuous sheet to the sheet entrance, and an end portion of the guide portion on a downstream side in a sheet traveling direction is configured as a fixed end resting on the sheet entrance, and another end portion thereof on an opposite side is configured as a swinging end which is elastically biased toward the continuous sheet by a spring force of a spring.

12 Claims, 11 Drawing Sheets

PRINT UNIT AND PRINTER

CROSS-REFERENCE TO RELATED APPLICATIONS

This application is a continuation of U.S. patent application Ser. No. 15/684,720, filed on Aug. 23, 2017, which is based upon and claims the benefit of priority from Japanese Patent Application No. 2016-173479, filed on Sep. 6, 2016, the entire contents of each of which are incorporated herein by reference.

FIELD

Embodiments described herein relate generally to a print unit and a printer.

BACKGROUND

In recent years, apparatuses printing receipts using a continuous sheet (for example, a sheet drawn from a roll of paper) have been widely used. For example, in most cases, a merchandise information processing apparatus (for example, a point of sales (POS) terminal) is equipped with a receipt printer which prints information such as transaction details on a sheet drawn from a paper roll (i.e., continuous sheet of paper).

The tension applied to the continuous sheet varies inside the apparatus in association with a change in conveyance speed or a change in diameter of the roll of paper. Since a change in the tension applied to the continuous sheet causes a decrease in print quality, most printers are equipped with a mechanism for adjusting the tension applied to the continuous sheet. In most cases, the mechanism for adjusting the tension applied to a continuous sheet is configured with a damper roller, which rotates in contact with one surface of the continuous sheet, and a swinging biasing mechanism, which swings the damper roller to adjust the tension applied to the continuous sheet.

DETAILED DESCRIPTION

Figure 1:
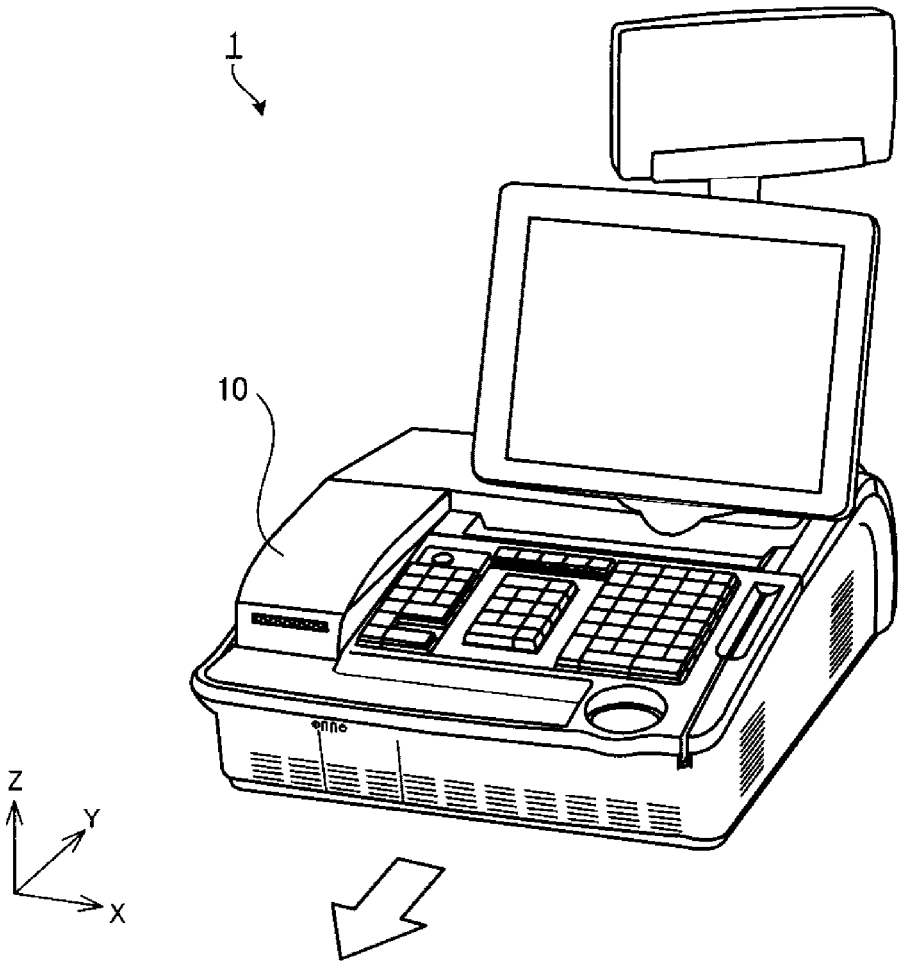
FIG. 1 is a perspective view illustrating a merchandise information processing apparatus equipped with a printer according to an embodiment.

The damper roller is located in front of (on the upstream side of) a print unit, and is, therefore, located, in most cases, immediately adjacent to an upstream end portion of a print unit. This location is suitable for being gripped by the user or the apparatus manufacturer. Therefore, when removing the print unit from the printer or when carrying the print unit, a person may inadvertently grip the damper roller. In this case, a large load composed of the weight of the print unit itself is applied to the damper roller and the swinging mechanism.

In order to prevent the damper roller and the swinging mechanism from being broken even on the occurrence of such a situation, the damper roller and the swinging mechanism have no choice but to be high-strength members. In this case, an apparatus (including a print unit) which is equipped with the mechanism for adjusting the tension applied to a continuous sheet becomes a high-cost product.

Embodiments reduce the cost of a printing apparatus equipped with a mechanism for adjusting the tension applied to a continuous sheet.

In general, according to one embodiment, a print unit is disposed in an apparatus having a printing function. The print unit includes a print engine configured to perform printing on a continuous sheet, and a damper located on an upstream side of a sheet entrance of the print engine in a sheet traveling direction and configured to adjust tension applied to the continuous sheet to be fed to the print engine. The damper includes a sheet guide having a planar guide portion which guides the continuous sheet to the sheet entrance, and an end portion of the guide portion on a downstream side in a sheet traveling direction is configured as a fixed end resting on the sheet entrance, and another end portion thereof on an opposite side is configured as a swinging end which is elastically biased toward the continuous sheet by a spring force of a spring.

Hereinafter, illustrative embodiments will be described with reference to the drawings. Furthermore, in the drawings, the same or similar components are assigned the respective same reference characters.

First Embodiment

FIG. 1 is a perspective view illustrating a merchandise information processing apparatus 1 equipped with a printer 10 according to an embodiment. The merchandise information processing apparatus 1 is, for example, a point of sales (POS) terminal. The merchandise information processing apparatus 1 is installed in a retail or other sales establishment and is operated by an operator. The merchandise information processing apparatus 1 is connected to a store server (e.g., POS server) (not illustrated) via a network. The printer 10 may be attached to, or incorporated into, the merchandise information processing apparatus 1.

Figure 2:
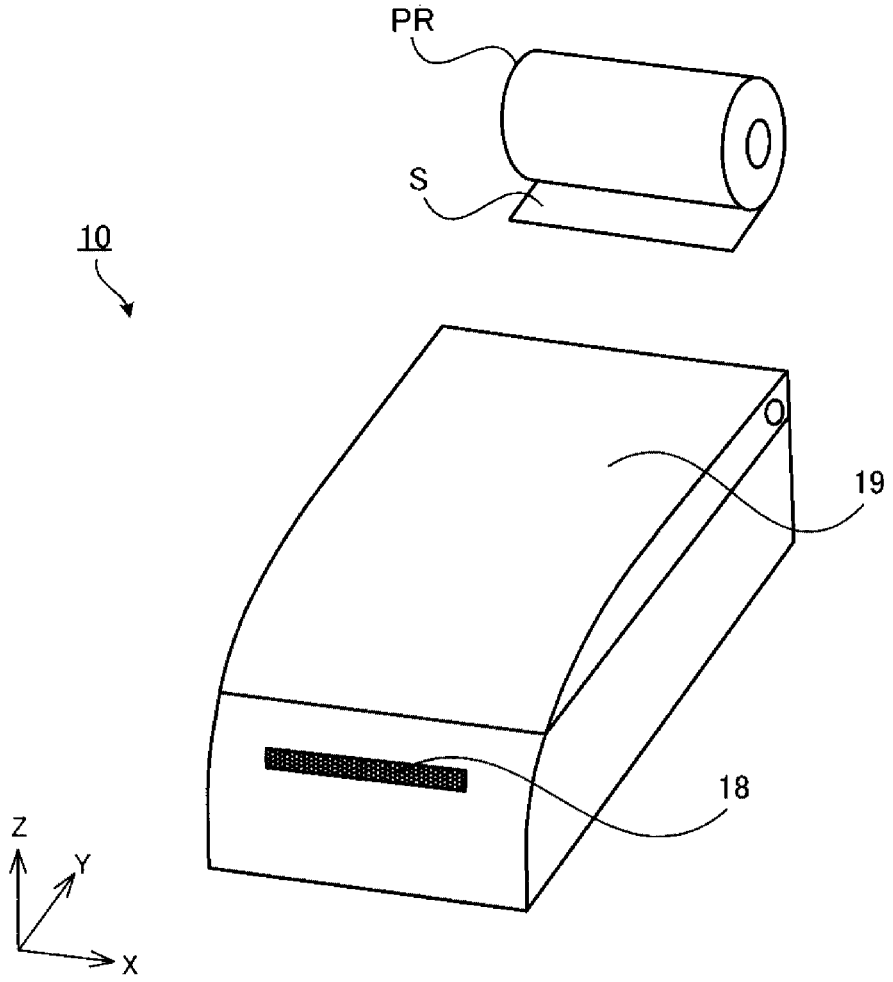
FIG. 2 is a perspective view of the printer according to the embodiment.

Furthermore, in the following description, an orthogonal coordinate system configured with an X-axis, a Y-axis, and a Z-axis is used. In the drawings, the direction indicated by an arrow is a plus direction. The X-axis plus direction is the leftward direction, and the X-axis minus direction is the rightward direction. Moreover, the Y-axis plus direction is the rearward direction, and the Y-axis minus direction is the frontward direction. Additionally, the Z-axis plus direction is the up direction, and the Z-axis minus direction is the down direction. The term "front side" refers to the side of a device on which an operator is positioned when using the device. In the example illustrated in FIG. 1, the frontwardly facing direction is a direction indicated by an open outlined arrow. Furthermore, in the present embodiment, the leftward direction is the direction to the left-hand side when the merchandise information processing apparatus 1 faces in the forward direction (when facing in a direction opposite to the direction in which the operator faces the merchandise information processing apparatus 1), and the rightward direction is the direction to the right-hand side when the merchandise information processing apparatus 1 faces in the forward direction. In the illustrations of FIG. 1 and FIG. 2, it should be noted that the rightward direction and the leftward direction are reverse to the illustrated right-hand side direction and left-hand side direction.

FIG. 2 illustrates the printer 10 of the merchandise information processing apparatus 1. The printer 10 is a receipt printer used to print and issue a receipt for a transaction. The printer 10 is equipped with a cover 19 at an upper portion thereof, and a roll of paper PR can be loaded to the interior thereof by opening the cover 19. The roll of paper PR is a roll-shaped printing medium having a continuous rolled sheet S. The continuous sheet S is a strip-like sheet. The printer 10 draws the continuous sheet S from the roll of paper PR and prints information, such as transaction details, on the continuous sheet S. The printer 10 includes a discharge port 18 through which to discharge the continuous sheet S on which the transaction details have been printed. The discharge port 18 is formed in the side wall of the printer 10 so as to discharge the continuous sheet S in the front facing direction. The appearance of the printer 10 illustrated in FIG. 1 and FIG. 2 is merely an example, and the appearance can be modified in various manners.

Figure 3:
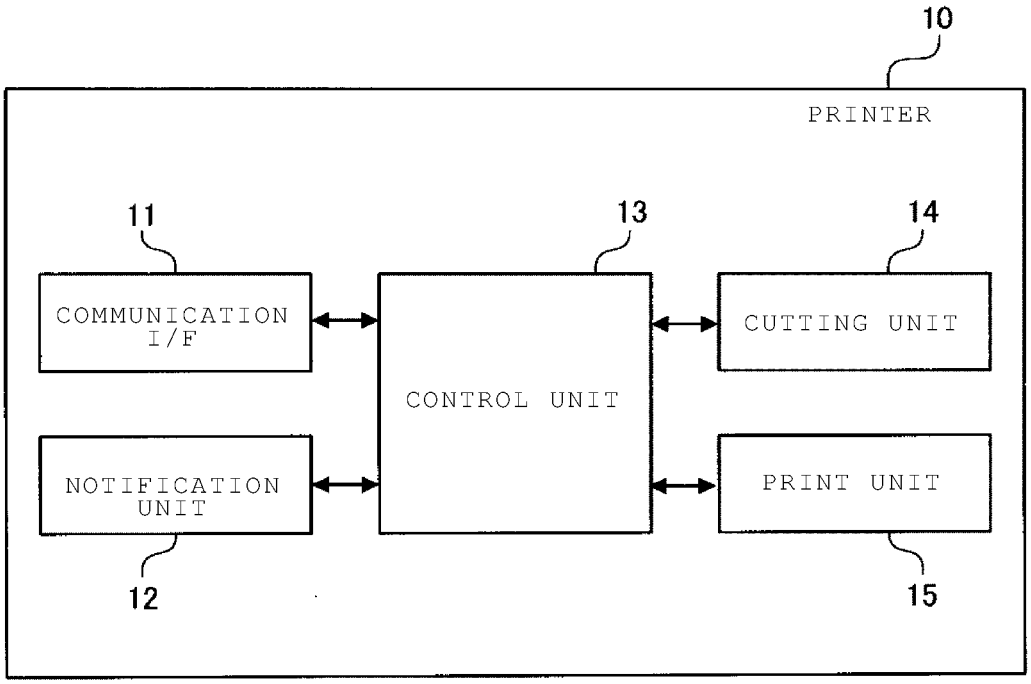
FIG. 3 is a block diagram of the printer according to the embodiment.

FIG. 3 is a block diagram illustrating components of the printer 10. The printer 10 includes a communication interface 11, a notification unit 12, a control unit 13, a cutting unit 14, and a print unit 15.

The communication interface 11 communicates with a control device (for example, a processor) of the merchandise information processing apparatus 1. The communication interface 11 acquires various elements of data from the merchandise information processing apparatus 1. Data which the communication interface 11 acquires from the merchandise information processing apparatus 1 includes information which the print unit 15 prints on the continuous sheet S (for example, transaction details).

The notification unit 12 is an output device used to notify the user of information. The notification unit 12 is, for example, a sound-generating apparatus, such as a loudspeaker or a buzzer. The notification unit 12 can be a display device, such as a liquid crystal display and an organic electroluminescence (EL) display. The notification unit 12 informs the user of, for example, the occurrence of running out of paper of the roll of paper PR or the occurrence of a conveyance abnormality of the continuous sheet S through the printer 10.

The control unit 13 is configured with a processing device such as a processor. The control unit 13 functions as a control device that controls each unit of the printer 10. The control unit 13 operates by executing a program stored in a storage device (a read-only memory (ROM) and/or a random access memory (RAM)) inside the control unit 13 or outside the control unit 13, thus implementing various operations, such as printing control of the print unit 15 and conveyance control of the continuous sheet S.

Figure 4:
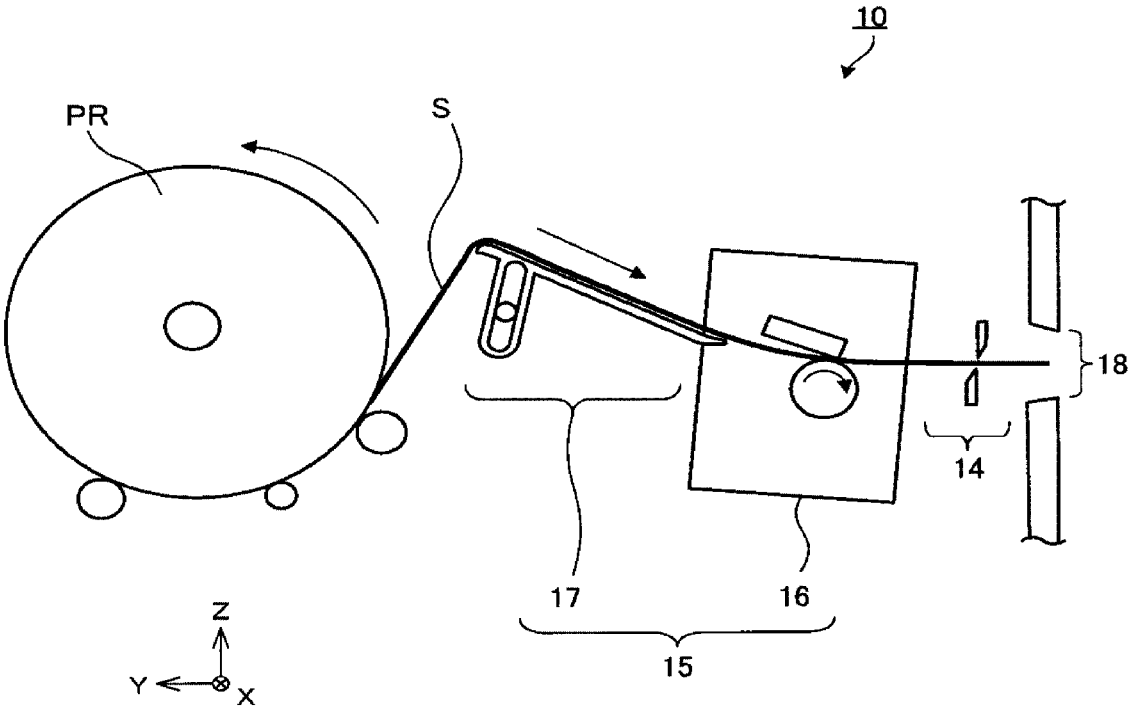
FIG. 4 is a diagram illustrating an internal structure of a printer according to a first embodiment.

FIG. 4 is a diagram illustrating an internal structure of the printer 10. The printer 10 is configured to allow the roll of paper PR to be detachably attached thereto. The continuous sheet S drawn from the roll of paper PR is subjected to printing of information thereon by the print unit 15. Then, a portion of the continuous sheet S on which the information is printed is cut off from the roll by the cutting unit 14 into a cut sheet, which is then discharged through the discharge port 18 (for example, as a receipt).

The cutting unit 14 can be a slide-type cutter or a roller-type cutter. In FIG. 4, a slide-type cutter is illustrated as an example of the cutting unit 14. Naturally, the configuration of the cutting unit 14 is not limited to this, but can be modified in various manners.

Figure 5:
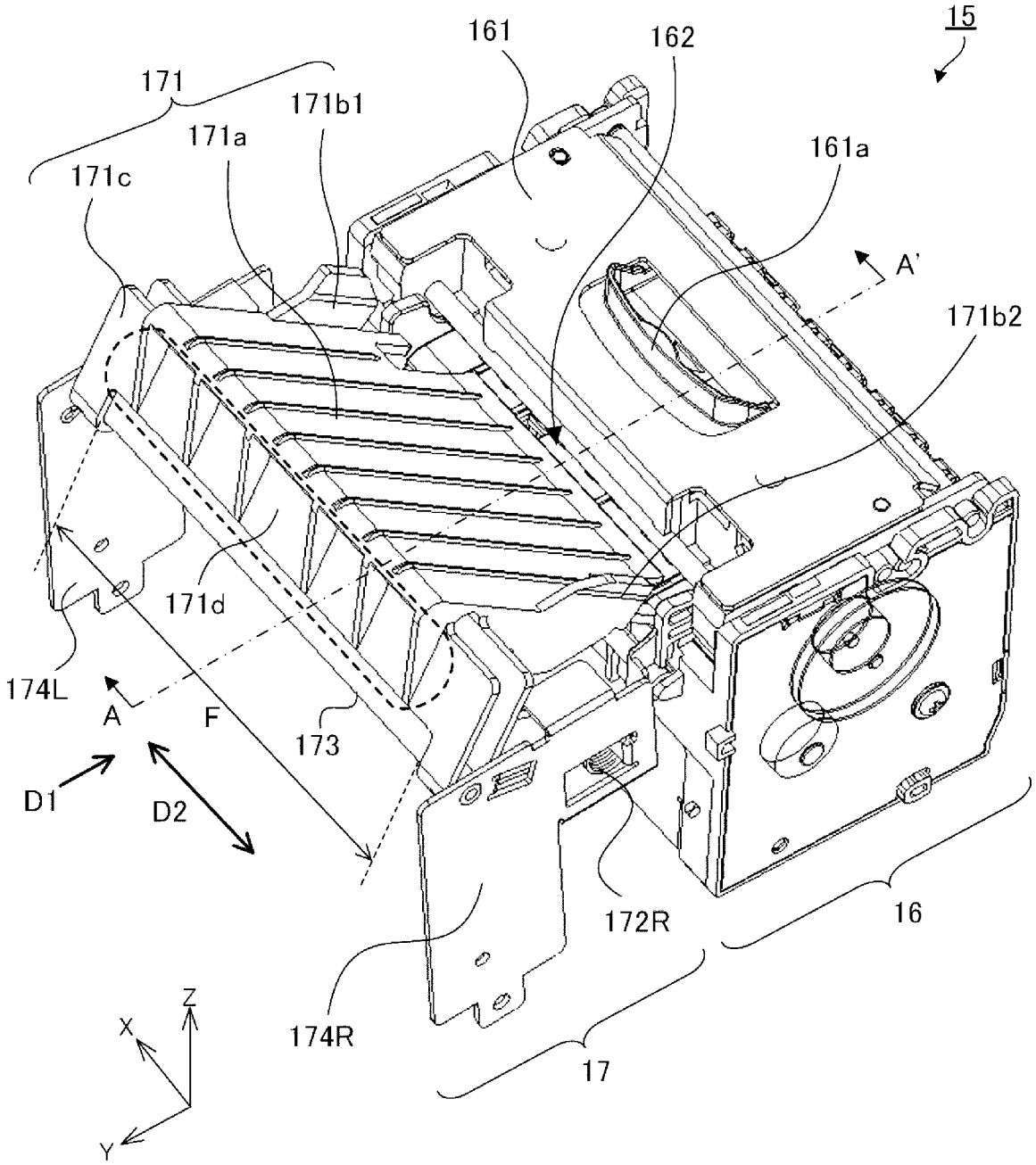
FIG. 5 is a perspective view of a print unit.
Figure 6:
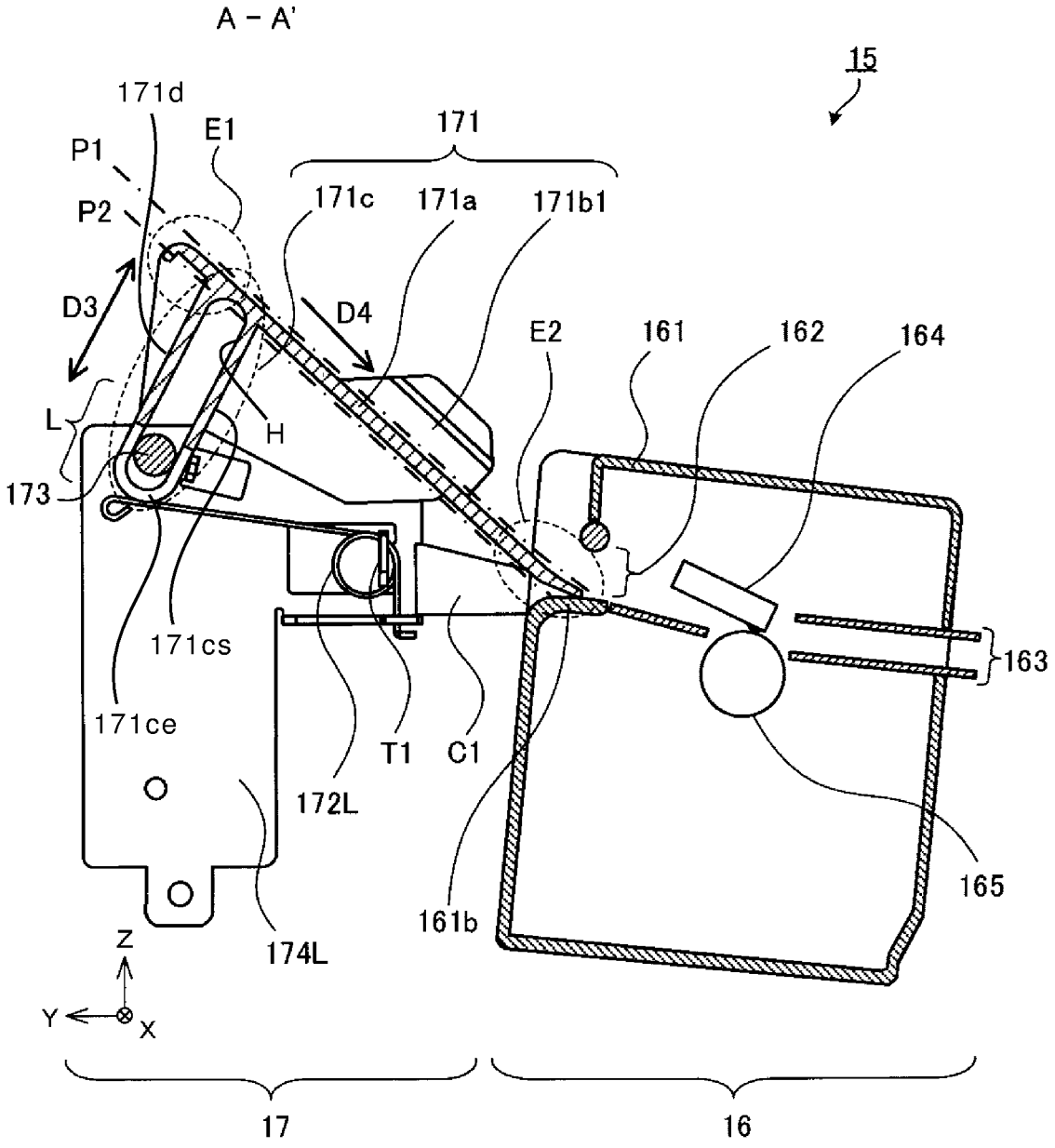
FIG. 6 illustrates a cross-section taken along line A-A' of the print unit illustrated in FIG. 5.

The print unit 15 prints information such as transaction details on the continuous sheet S. FIG. 5 is a perspective view of the print unit 15. FIG. 6 illustrates a cross-section taken along line A-A' of the print unit 15 illustrated in FIG. 5. In FIG. 6, in order to facilitate viewing the structure of the print unit 15, some elements of the print unit 15 are omitted from the illustration.

The print unit 15 is an assembly which assumes the role of printing to be performed by the printer 10. The assembly is componentry in which a plurality of parts is assembled. The print unit 15 has integrally configured structure and is thus able to be carried alone. The print unit 15 is attached to the printer 10 by a factory worker at a plant for the manufacture of printers 10. To facilitate the maintenance of the printer 10, the print unit 15 can be configured to be detachably attached to the printer 10. As illustrated in FIG. 5, the print unit 15 includes a print engine 16 and a damper 17.

The print engine 16 is a section of the print unit 15 which prints the transaction information on the continuous sheet S. Here, the print engine 16 is a section of the print unit 15 which assumes the role of a physical printing process of an apparatus having a printing function (for example, a printer or a merchandise information processing apparatus). In the case of an electrophotographic-type printer, the print engine is a section of the print unit 15 which assumes the role of, for example, electrostatically charging an image carrier (for example, a photosensitive drum), controlling the radiation of light (for example, laser light) directed toward the image carrier, applying toner to the image carrier, transferring toner onto a sheet, and fixing of toner to the sheet. Furthermore, in a case where the print engine is a thermal-type printer, the print engine is a portion which, for example, transfers ink to a sheet or forms colors on a sheet of thermal paper using, for example, heat.

In the present embodiment, the print engine 16 is a thermal-type print engine as an example. As illustrated in FIG. 6, the print engine 16 includes a casing 161, a sheet entrance 162, a sheet exit 163, a print head 164, and a roller 165.

The casing 161 is, for example, a rectangular box body. A handle 161*a* is attached to the upper surface of the casing 161, as illustrated in FIG. 5. The handle 161*a* is used by the factory worker, user, or a maintenance person, to carry the print unit 15. As illustrated in FIG. 6, the sheet entrance 162 is formed in a surface on the sheet path upstream side (the Y-axis plus direction side) of the casing 161, and the sheet exit 163 is formed in a surface on the sheet path downstream side (the Y-axis minus direction side) thereof.

The sheet entrance 162 is an entrance port for receiving the continuous sheet S into the casing 161 of the print engine 16. Furthermore, the sheet exit 163 is an exit port for discharging the continuous sheet S to the outside of the casing 161 of the print engine 16. In the present embodiment, the sheet entrance 162 and the sheet exit 163 are formed as respective openings formed through opposed walls of the casing 161. A conveyance roller (not illustrated) is located at the sheet entrance 162, and, when the user inserts an end portion of the continuous sheet S into the sheet entrance 162, the conveyance roller of the print engine 16 pulls the continuous sheet S into the casing 161. The continuous sheet S pulled into the casing 161 through the sheet entrance 162 passes between the print head 164 and the roller 165 and is then discharged from the sheet exit 163 to the outside of the print engine 16. The casing 161 includes a placement portion 161*b* on which to place the end portion of a sheet guide 171. The placement portion 161*b* is a portion, which extends in horizontal direction, located on the upstream side of the sheet entrance 162.

The print head 164 and the roller 165 are located across a sheet travel path inside the casing 161. The print head 164 is a thermal head, and the roller 165 is a platen roller which biases the continuous sheet S against the print head 164. The roller 165 also functions as a conveyance unit that conveys the continuous sheet S toward the sheet exit 163. A conveyance mechanism other than the roller 165 (for example, a conveyance roller or a conveyance belt) can be located inside the casing 161. The print engine 16 causes the print head 164 and the roller 165 to operate under the control of the control unit 13, thus printing information on the continuous sheet S.

Figure 7:
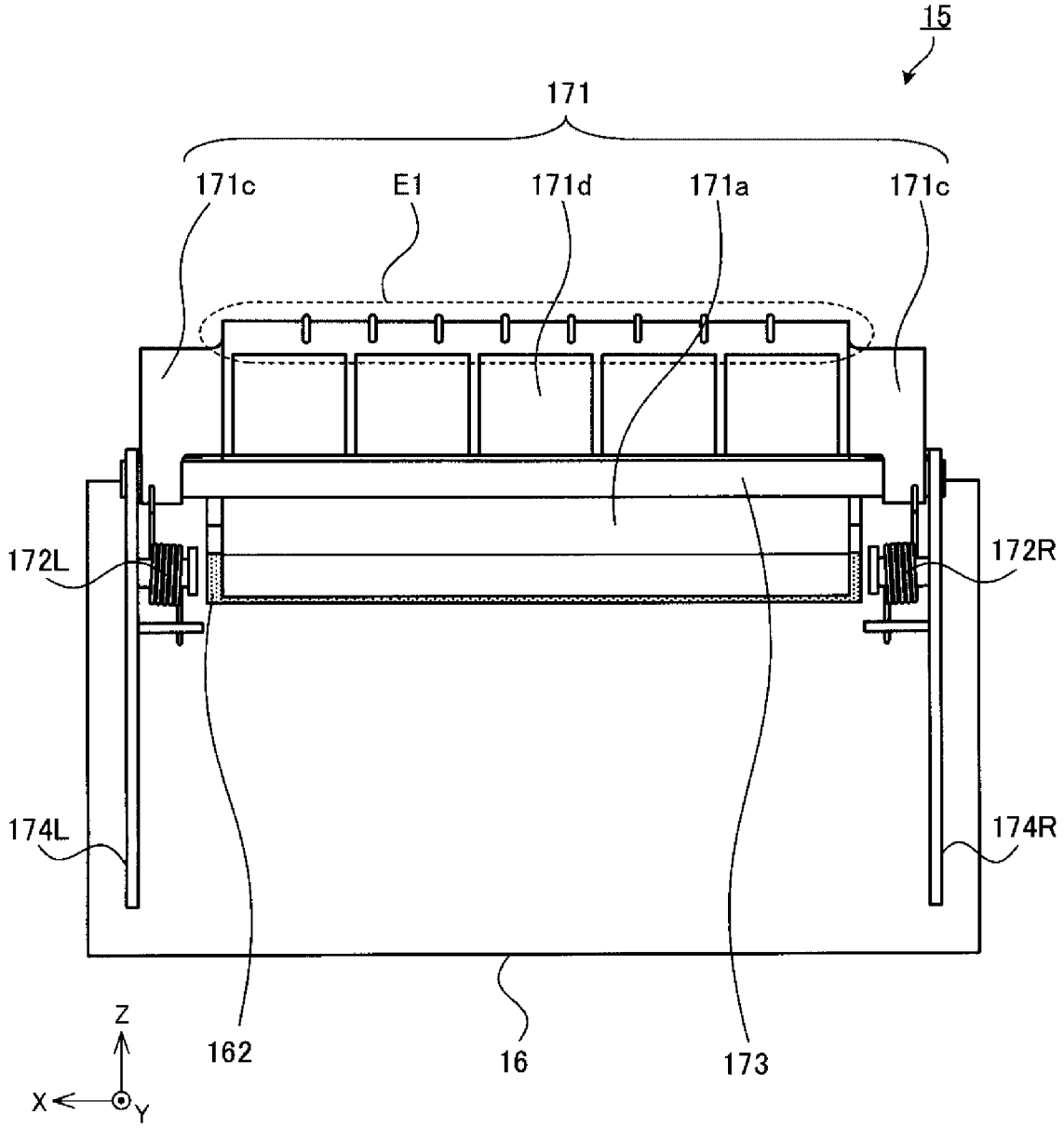
FIG. 7 is a diagram illustrating the print unit as viewed from the back side thereof.
Figure 8:
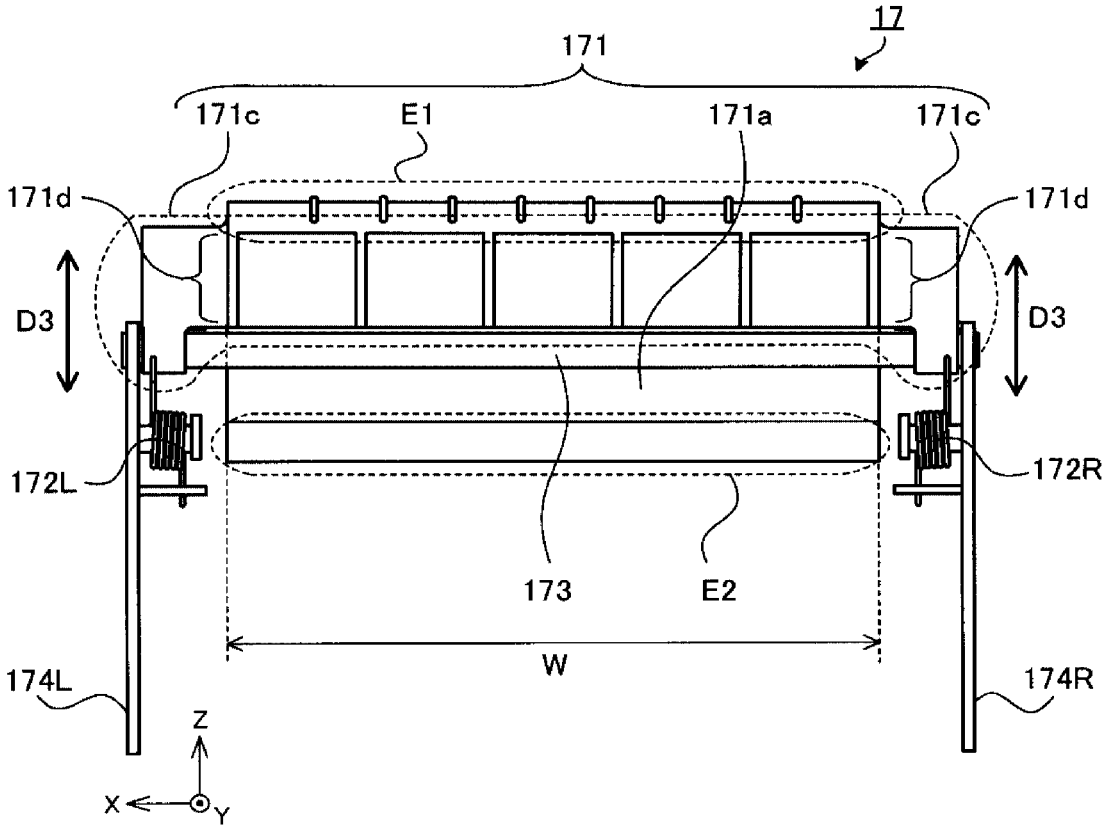
FIG. 8 illustrates a damper as extracted from the print unit illustrated in FIG. 7.

The damper 17 is a mechanism configured to adjust the tension applied to the continuous sheet S being supplied to the print engine 16. The damper 17 is located on the upstream side (the Y-axis plus direction side) of the sheet entrance 162 of the print engine 16. FIG. 7 is a diagram illustrating the print unit 15 as viewed from the back side thereof (the direction D1 illustrated in FIG. 5). Furthermore, FIG. 8 illustrates the damper 17 as extracted from the print unit 15 illustrated in FIG. 7. In FIG. 7 and FIG. 8, in order to facilitate viewing the structure of the damper 17, some elements thereof are omitted from the illustration.

As illustrated in FIG. 8, the damper 17 includes a sheet guide 171, damper springs 172L and 172R, a shaft 173, and frames 174L and 174R.

The sheet guide 171 is configured to guide the continuous sheet S as it is conveyed. As illustrated in FIG. 5, the sheet guide 171 includes a guide portion 171*a*, side guides 171*b*1 and 171*b*2, and a swinging guide 171*c*.

The guide portion 171*a* is a planar portion that guides the continuous sheet S to the sheet entrance 162 of the print unit 15. In the example illustrated in FIG. 6, the guide portion 171*a* is the structure sandwiched between two dashed-dotted lines (P1 and P2). In the present embodiment, the upper surface side (the side P1) of the guide portion 171*a* serves as a guide surface facing the continuous sheet S. In the following description, the surface facing the continuous sheet S of the guide portion 171*a* is referred to as a "sheet facing surface P1", and a surface on the opposite side thereof is referred to as an "opposite surface P2".

An end portion E2 of the guide portion 171*a* in the sheet traveling direction is configured as a fixed end fixed in position with respect to the sheet entrance 162. Furthermore, an end portion E1 of the guide portion 171*a* on the opposite side (the upstream side) is configured as a swinging end which is swung by spring forces of the damper springs 172L and 172R. Here, the sheet traveling direction refers to a direction in which the continuous sheet S travels out of directions parallel to the sheet facing surface P1. In the example illustrated in FIG. 6, the sheet traveling direction is the direction indicated by an arrow D4. Swinging directions of the swinging end E1 is a direction perpendicular to the sheet traveling direction D4 or a direction somewhat inclined to the direction perpendicular to the sheet traveling direction D4 (directions indicated by a double-headed arrow D3 illustrated in FIG. 6). Furthermore, the fixed end E2 is only placed at the placement portion 161*b* of the casing 161. In other words, the fixed end E2 rests on the sheet entrance 162, and is not firmly fixed to the casing 161.

The side guides 171*b*1 and 171*b*2 are located on the sheet facing surface P1 of the guide portion 171*a*. As illustrated in FIG. 5, the side guides 171*b*1 and 171*b*2 are located at both ends in the sheet width direction D2 of the guide portion 171*a*. The side guide 171*b*1 is located at the left-side end portion of the guide portion 171*a*, and the side guide 171*b*2 is located at the right-side end portion of the guide portion 171*a* when viewed form the end portion E1 of the guide portion 171*a*. The sheet width direction D2 is a width direction of the continuous sheet S located on the sheet facing surface P1. In the present embodiment, the sheet width direction D2 is the X-axis direction. The side guides 171*b*1 and 171*b*2 are configured to correct skew of the continuous sheet S traveling toward the sheet entrance 162.

The swinging guide 171*c* regulates the position of the swinging end E1. As illustrated in FIG. 6, the swinging guide 171*c* is located on the side of the surface P2 of the guide portion 171*a*. The swinging guide 171*c* is formed of a part of the guide portion 171*a*, a cover 171*d*, a side wall 171*cs*, and an end portion 171*ce*. The swinging guide 171*c* has a slot H formed by the guide portion 171*a*, a downstream side surface of the cover 171*d*, an upstream side surface of the side wall 171*cs*, and an upper surface of the end portion 171*ce*. The slot H has a longitudinal direction parallel to the swinging directions D3 of the swinging end E1 as viewed from the axial direction of the shaft 173 (the X-axis direction). The shaft 173 extends in the sheet width direction D2, and is inserted into the slot H. The swinging guide 171*c* limits the swinging directions of the swinging end E1 to the directions D3 illustrated in FIG. 6 by being subjected to interference with the shaft 173.

As illustrated in FIGS. 5-8, the sheet guide 171 includes the cover 171*d*, which covers a gap between the shaft 173 and the swinging end E1. In the present embodiment, the cover 171*d* is a part of the swinging guide 171*c*, but does not necessarily need to be a part of the swinging guide 171*c*. The width W of the cover 171*d* is approximately the same as the width of the swinging end E1. Since the cover 171*d* covers the swing end E1 from the right end thereof to the left end thereof in the sheet width direction D2, for example, it is difficult for the factory worker to insert his or her hand between the swinging end E1 and the shaft 173.

The damper springs 172L and 172R are springs which bias the sheet guide 171. In the present embodiment, each of the damper springs 172L and 172R is a coil spring which is a type of torsion spring. Naturally, the damper spring is not limited to a coil spring, but can be, for example, a compression coil spring. The coil portion of the damper spring 172L is fixed to the left-side frame 174L of the print engine 16 by an extending arm. Furthermore, the coil portion of the damper spring 172R is fixed to the right-side frame 174R of the print engine 16 by an extending arm.

Each of the damper springs 172L and 172R has two arms. One arm of the damper spring 172L is fixed to a projection of the frame 174L, and the other arm thereof is in contact with the lower end of the swinging guide 171*c*. Similarly, one arm of the damper spring 172R is fixed to a projection of the frame 174R, and the other arm thereof is in contact with the lower end of the swinging guide 171*c*. Each of the damper springs 172L and 172R urges the sheet guide 171 upwardly. The swinging end E1 of the sheet guide 171 is swung in the swinging directions D3 using the spring forces of the damper springs 172L and 172R.

Figure 9:
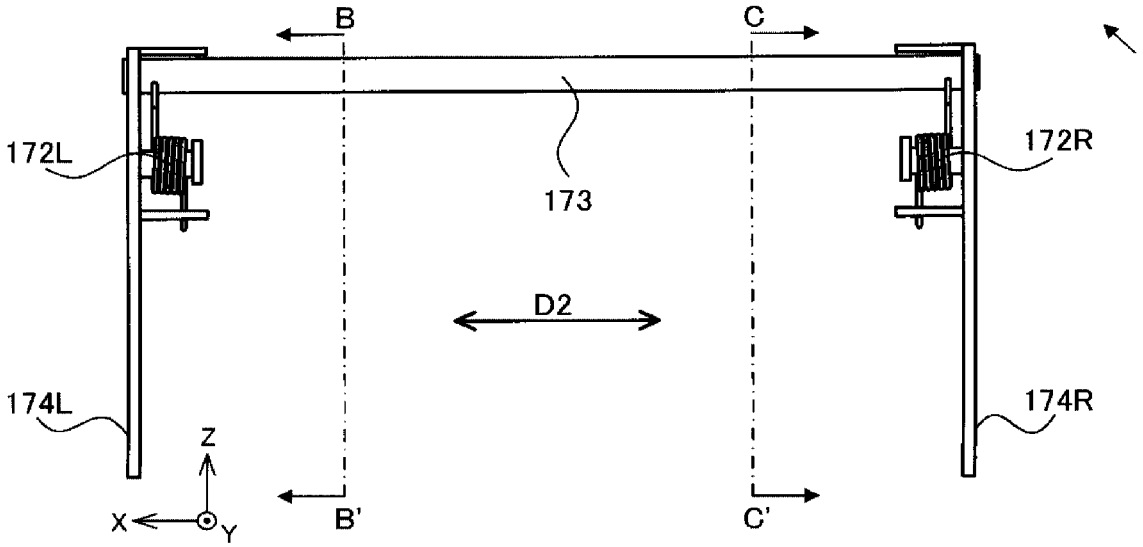
FIG. 9 illustrates the damper illustrated in FIG. 8 with a sheet guide removed therefrom.

The shaft 173 regulates a motion of swinging of the sheet guide 171. The shaft 173 is fixed to the frame of the print unit 15 in such a manner that a direction parallel to the guide portion 171*a* and perpendicular to the sheet traveling direction D4 is the axial direction of the shaft 173. FIG. 9 illustrates the damper 17 illustrated in FIG. 8 in a case where the sheet guide 171 is removed therefrom. The shaft 173 extends in the sheet width direction D2 between the left-side frame 174L and the right-side frame 174R of the print unit 15. The shaft 173 is immovable relative to the frames 174L and 174R. The shaft 173 is formed of a high-rigidity metal, such as steel or aluminum, in such a way as not to be deformed even by the application of a load thereon during use. That is, the frames 174L and 174R are frames extending from and connected to the print engine 16, which support the damper 17 at both sides thereof in the sheet width direction D2.

As illustrated in FIG. 5 and FIG. 6, when the continuous sheet S is not present on the guide portion 171*a*, the shaft 173 is located at the lower end (a portion L illustrated in FIG. 6) of the slot H in the side of the swinging end E1 of the sheet guide 171. The surface of the sheet guide at the lower end L is parallel to the axial direction of the shaft 173 (the X-axis direction). Since, when lifting up the print unit 15, the factory worker, user, or maintenance person is able to grasp the shaft 173 and the lower end L of the sheet guide 171 at the same time, no large load (stress) is applied to the print unit 15. In addition, since no large load is applied to the sheet guide 171, the sheet guide 171 does not necessarily need to be made from a high-strength material (for example, a metal, such as iron or aluminum). The material of the sheet guide 171 can be an inexpensive hard resin.

Furthermore, the shaft 173 is exposed at the lower end L of the swinging end E1 of the sheet guide 171. In the case of the print unit 15 of the present embodiment, a middle portion of the shaft 173 in the axial direction (a portion F illustrated in FIG. 5) is exposed to the outside of the swinging guide 171*c*. Since the shaft 173 is exposed, when lifting the print unit 15 up, for example, the factory worker can easily grasp the shaft 173. Furthermore, an indication indicating that the shaft 173 is a portion to be grasped (for example, "grasp this portion to lift up") can be attached to the exposed portion F or the vicinity thereof (for example, the cover 171*d*).

The frame 174L is located on one side (left side) in the sheet width direction D2 of the sheet guide 171, and the frame 174R is located on the other side (right side) in the sheet width direction D2 of the sheet guide 171. Each of the frames 174L and 174R is a plate-like frame. Each of the frames 174L and 174R is formed of a high-rigidity metal, such as iron or aluminum, in such a way as to be able to support the shaft 173 without being deformed even by the application of a load to the shaft 173.

Figure 10A:
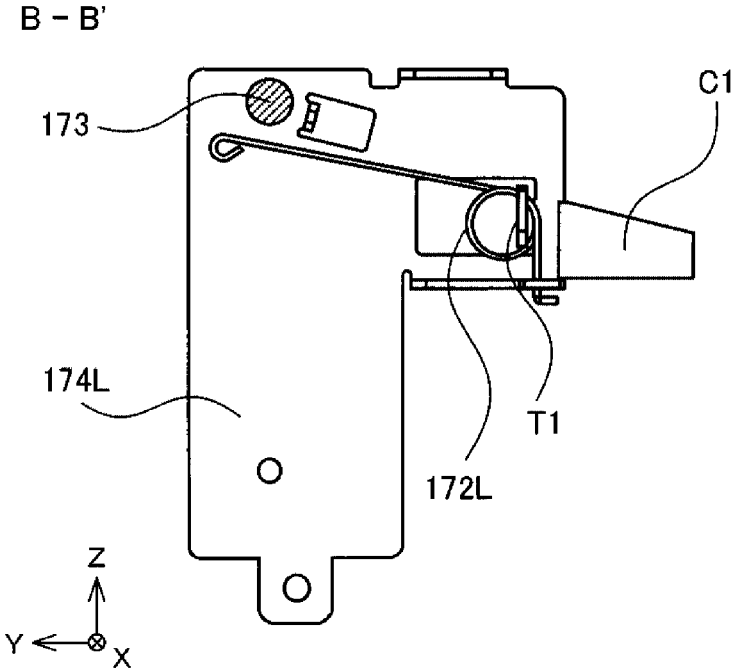
FIG. 10A is a sectional view taken along line B-B' in FIG. 9.
Figure 10B:
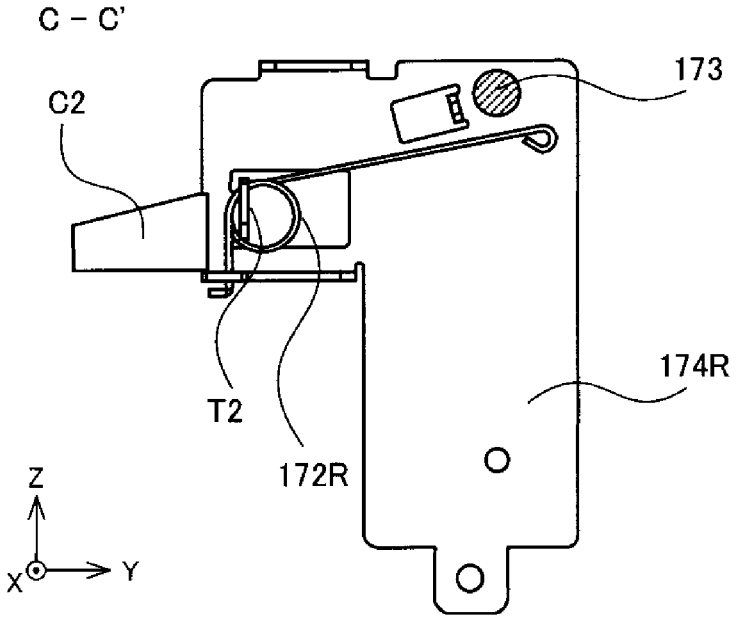
FIG. 10B is a sectional view taken along line C-C' in FIG. 9.

FIG. 10A is a sectional view taken along line B-B' in FIG. 9, and FIG. 10B is a sectional view taken along line C-C' in FIG. 9. The frames 174L and 174R are mirror symmetric with respect to the x-axis. The frame 174L has a projection portion T1 which projects in the X-axis toward the frame 174R. Furthermore, the frame 174R has a projection portion T2 which projects in the X-axis toward the frame 174L. The coil portion of the damper spring 172L is fixed to the projection portion T1, and the coil portion of the damper spring 172R is fixed to the projection portion T2.

The frame 174L has a joining portion C1 which is fixed to the casing 161 of the print engine 16. Furthermore, the frame 174R has a joining portion C2 which is fixed to the casing 161 of the print engine 16. The frames 174L and 174R are fixed to the casing 161 via the joining portions C1 and C2 with the planar surfaces thereof facing each other.

Next, an operation of the printer 10 having the above-described configuration is described.

The control unit 13 of the printer 10 starts print processing upon receiving a print starting instruction from the merchandise information processing apparatus 1. When the print processing is started, the conveyance section (for example, the roller 165) of the printer 10 starts conveying the continuous sheet S. The conveyance section changes the conveyance speed of the continuous sheet S according to control by the control unit 13.

Figure 11:
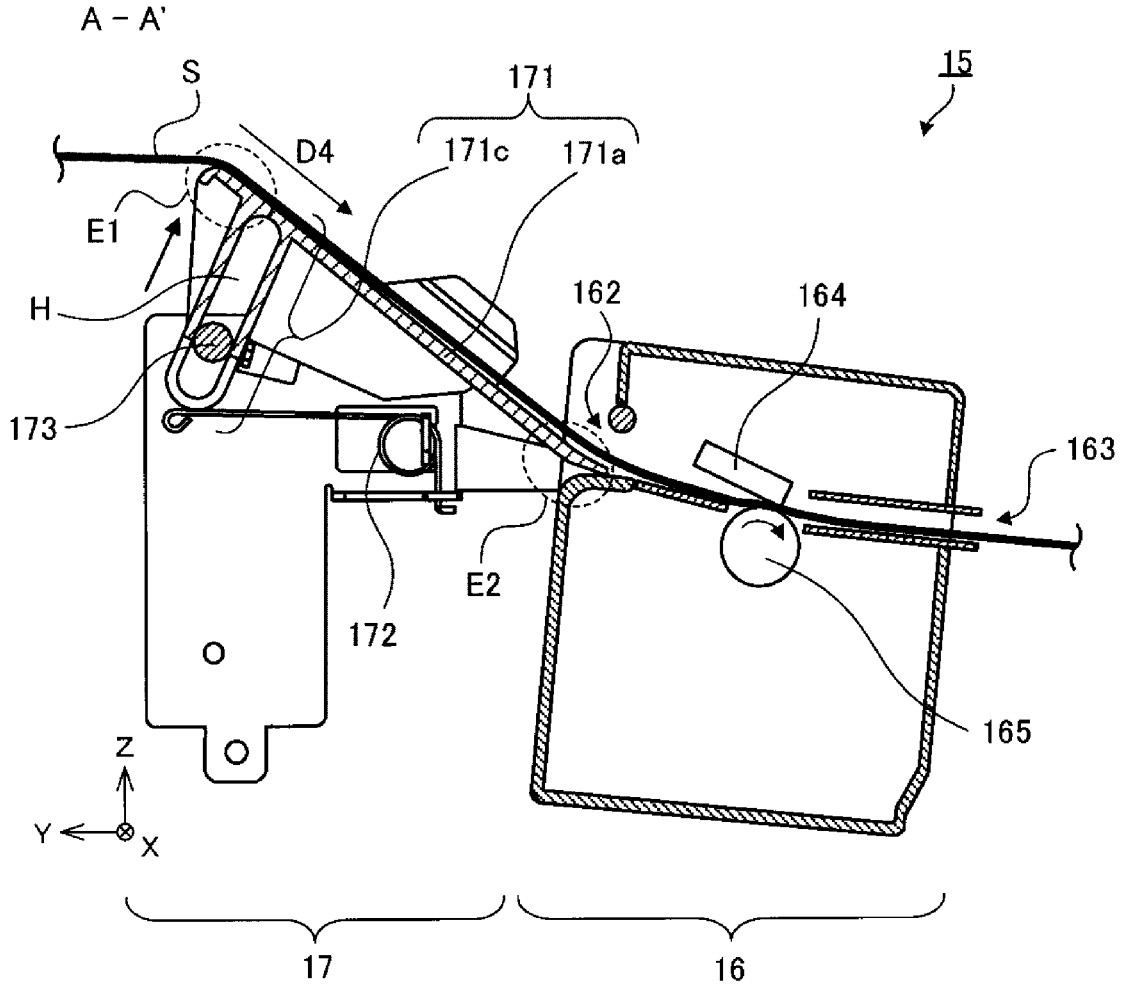
FIG. 11 is a diagram illustrating the print unit under a condition in which the conveyance speed of a continuous sheet is low.

FIG. 11 is a diagram illustrating the print unit 15 under a condition in which the conveyance speed of the continuous sheet S is low (for example, at the time of normal printing or immediately after the start of conveyance of the continuous sheet S). When the conveyance speed of the continuous sheet S is low or when the diameter of the roll of paper PR is small, a force with which the conveyance section (for example, the roller 165) pulls the continuous sheet S against inertia (the moment of inertia) of the roll of paper PR is not very large. In other words, no large amount of tension is applied to the continuous sheet S. Therefore, since a force with which the continuous sheet S pushes down on the guide portion 171*a* of the sheet guide 171 is not very large, the swinging end E1 of the sheet guide 171 becomes balanced at the position where the swinging end E1 is greatly lifted upward by the spring force of the damper springs 172L and 172R (hereinafter referred to simply as a "damper spring 172"), and the continuous sheet S is conveyed with a tension slightly lower than the inertia (the moment of inertia) of the roll of paper PR.

Figure 12:
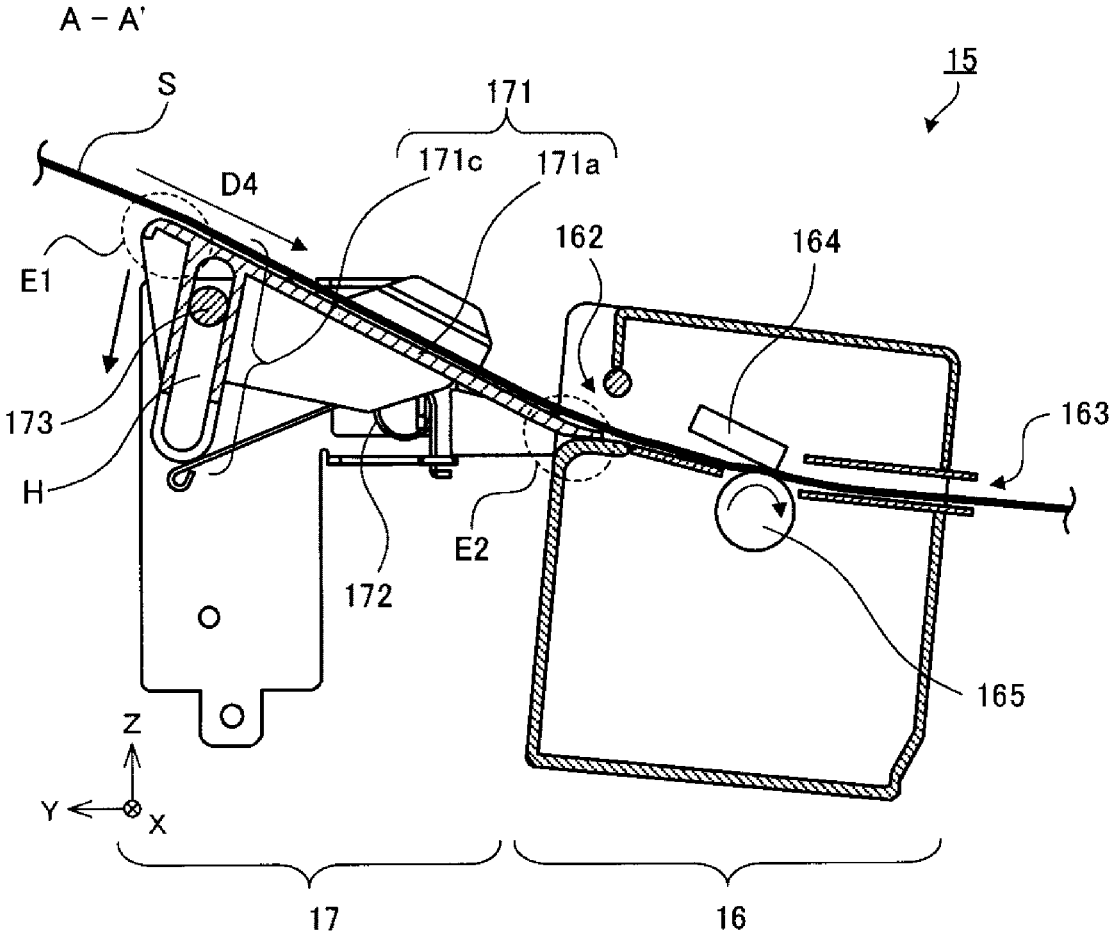
FIG. 12 is a diagram illustrating the print unit under a condition in which the conveyance speed of a continuous sheet is high.

FIG. 12 is a diagram illustrating the print unit 15 under a condition in which the conveyance speed of the continuous sheet S is high (for example, at the time of high-speed printing). When the conveyance speed of the continuous sheet S is high or when the diameter of the roll of paper PR is large, the continuous sheet S is strongly pulled by the conveyance section against the inertia (the moment of inertia) of the roll of paper PR, and a large tension is applied to the continuous sheet S. Therefore, the swinging end E1 of the sheet guide 171 becomes balanced at the position where the swinging end E1 is pushed down to a great extent against the spring force of the damper springs 172, and the tension applied from the sheet guide 171 to the continuous sheet S becomes small. The continuous sheet S is conveyed with a tension much lower than the inertia (the moment of inertia) of the roll of paper PR.

In this way, as the sheet guide 171 swings, the tension applied to the continuous sheet S is reduced. More specifically, when the tension applied to the continuous sheet S is small, the sheet guide 171 swings up to a small extent, and, when the tension applied to the continuous sheet S is large, the sheet guide 171 swings up to a large extent. The swinging of the sheet guide 171 to a large extent causes a reduction of the tension applied to the continuous sheet S.

According to the present embodiment, the damper 17 is configured without a damper roller which swings in contact with one surface of a continuous sheet but the sheet guide 171 which swings in contact with one surface of a continuous sheet. The sheet guide 171 is configured with the planar guide portion 171*a* and is not in a roll shape. The user can definitely recognize that the sheet guide 171 is not a portion to be gripped. Therefore, the user is less likely to erroneously grip the sheet guide 171. As a result, since the damper 17 does not need to be a high-strength member, the cost of the print unit 15 can be reduced. The cost of an apparatus equipped with the print unit 15 (the printer 10 and the merchandise information processing apparatus 1) can also be reduced.

Furthermore, in the case of a usual printer in which the damper roller is swung by a swinging mechanism (for example, a swinging arm), the user may sometimes set the continuous sheet S to an erroneous position. For example, while, originally, the continuous sheet S should pass above the damper roller, the user may sometimes erroneously pass the continuous sheet S below the damper roller. In this case, a conveyance abnormality of the sheet S or a decrease in printing quality is caused. However, in the case of the print unit 15 in the present embodiment, a swinging member is not the damper roller but is the sheet guide 171. The sheet guide 171 includes the planar guide portion 171*a*, so that a position through which the continuous sheet S should pass is visually definite. Therefore, the user is less likely to set the continuous sheet S to an erroneous position.

Furthermore, the print unit 15 includes the shaft 173, which is fixed to the frames 174L and 174R. Even if, when carrying the print unit 15, the user grips the damper 17, the resultant position where the user grips is not the sheet guide 171 but the shaft 173. Therefore, when the user detaches the print unit 15 from the printer 10 or carries the print unit 15, the print unit 15 is less likely to be damaged. Moreover, the shaft 173 is an immovable member which is merely fixed to the frames, and, therefore, has only a small influence on the cost of the print unit 15.

Furthermore, the print unit 15 includes the cover 171*d*, which covers a gap between the shaft 173 and the swinging end E1. Since the user is unable to insert the user's hand into the gap between the shaft 173 and the swinging end E1, it becomes physically difficult to grip the sheet guide 171. Accordingly, the print unit 15 is much less likely to be damaged. Moreover, since the cover 171*d* is provided, the user is also less likely to erroneously set the continuous sheet S to between the shaft 173 and the swinging end E1.

Second Embodiment

While, in the first embodiment, the printer 10 allows only one roll of paper PR to be loaded therein, the printer 10 can be configured to allow a plurality of rolls of paper to be loaded thereon.

Figure 13:
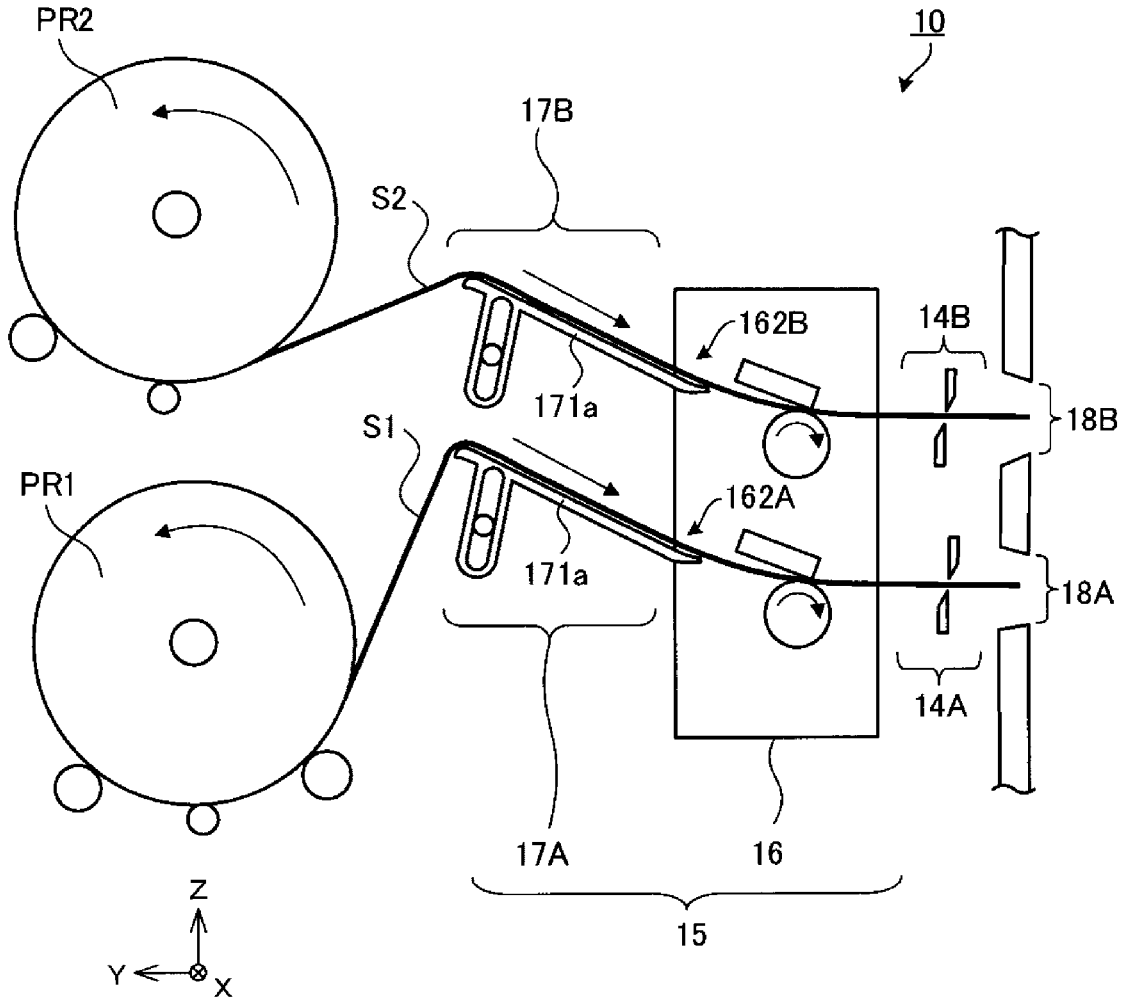
FIG. 13 is a diagram illustrating an internal structure of a printer according to a second embodiment.

FIG. 13 is a diagram illustrating a printer 10 according to a second embodiment. The printer 10 according to the second embodiment allows a plurality of rolls of paper PR1 and PR2 to be loaded therein. The printer 10 has a plurality of discharge ports 18A and 18B. Cutting units 14A and 14B are arranged on the upstream side of the plurality of discharge ports 18A and 18B, respectively. Furthermore, the print unit 15 includes a print engine 16 and a plurality of dampers 17A and 17B. The configurations of the other components of the printer 10 are similar to those of the printer 10 in the first embodiment.

The print engine 16 has a plurality of sheet entrances 162A and 162B, which serve as entrance ports for continuous sheets S1 and S2. The dampers 17A and 17B are located on the upstream side of the sheet entrances 162A and 162B, respectively. Each of the dampers 17A and 17B includes a planar guide portion 171*a* which guides one of the continuous sheets S1 and S2 to one of the sheet entrances 162A and 162B. The configurations of the other components of the print engine 16 and the dampers 17A and 17B are similar to those of the print engine 16 and the damper 17 described in the above embodiment.

With regard to a printer which allows a plurality of rolls of paper to be loaded thereon, the position to which to set a continuous sheet is hard to grasp for the user. In particular, in a case where the mechanism for adjusting the tension applied to the continuous sheet is a damper roller, since a plurality of rollers are arranged on the upstream side of the print engine, where to pass the continuous sheet is hard to grasp for the user. However, in the case of the printer in the present embodiment, the mechanism for adjusting the tension applied to the continuous sheet is the planar guide portion 171*a*. Since it is easy to visually recognize the positions to which to set the continuous sheets S1 and S2, the user is less likely to set the continuous sheet S1 or S2 to an erroneous position.

Each of the above-described embodiments is merely an example, and can be modified in various manners and applied to various usages.

For example, while, in the first and second embodiments, the print engine 16 includes the casing 161, the print engine 16 does not need to include the casing 161. The print engine 16 can be configured to be only surrounded by a rim-like frame or can be configured to be only sandwiched between the left plate-like frame and the right plate-like frame.

Furthermore, while, in the first and second embodiments, the sheet entrances 162, 162A, and 162B of the print engine 16 are openings formed on the casing 161, the sheet entrances 162, 162A, and 162B do not need to be openings formed on the casing 161. For example, the sheet entrance 162, 162A, or 162B can be the mounting position of a conveyance section (for example, a conveyance belt or a conveyance roller) located on the upstream side of the print head 164 and the roller 165. At this time, the sheet entrance 162, 162A, or 162B can be a portion sandwiched between a conveyance roller and a conveyance roller or can be a portion sandwiched between a conveyance belt and a conveyance roller. Moreover, the sheet entrance 162, 162A, or 162B can be merely a boundary between the inside and the outside of the print engine 16 out of a conveyance pathway for the continuous sheet S.

Furthermore, while, in the first and second embodiments, the fixed end E2 of the guide portion 171*a* is placed at each of the sheet entrances 162, 162A, and 162B, the method for fixing the position of the fixed end E2 to each of the sheet entrances 162, 162A, and 162B is not limited to placement on the placement portion 161*b*. For example, the fixed end E2 can be rotatably (for example, in the shape of a joining portion of the hinge) fixed to a portion of the casing 161 on the upstream side of the sheet entrance 162, 162A, or 162B. Naturally, as long as the position of the fixed end E2 is fixed with respect to the sheet entrance 162, 162A, or 162B, the location method thereof is optional.

Moreover, while, in the first and second embodiments, the shaft 173 and the frames 174L and 174R are made from a metal, the shaft 173 and the frames 174L and 174R do not need to be made from a metal. The shaft 173 or the frame 174L or 174R can be configured with a hard resin.

Additionally, while, in the first and second embodiments, the sheet guide 171 is configured with a hard resin, the material of the sheet guide 171 does not necessarily need to be a hard resin. The sheet guide 171 can be configured with a metal, such as iron or aluminum.

Furthermore, while, in the first and second embodiments, the cover 171*d* is a part of the sheet guide 171, the cover 171*d* can be a member separate from the sheet guide 171. For example, the cover 171*d* can be a plate-like body fixed to the shaft 173 separately from the sheet guide 171.

Moreover, while, in the first and second embodiments, the slot H is formed to linearly extend along the swinging direction D3, the slot H does not necessarily need to be configured in a straight linear fashion. For example, the slot H can be gently curved in an arc-like shape. At this time, the swinging directions D3 of the swinging end E1 can also be curved along the slot H.

Although in the first and second embodiments, the print engine 16 is a thermal-type print engine, the print engine 16 is not limited to the thermal-type print engine. For example, the print engine 16 can be a dot impact-type, inkjet-type, or electrophotographic-type print engine.

Moreover, while, in the first and second embodiments, the printer 10 is fixed to or incorporated in the merchandise information processing apparatus 1, the printer 10 can be configured to be externally attachable to the merchandise information processing apparatus 1. For example, the printer 10 can be equipped with a connection interface, such as Universal Serial Bus (USB), and can be configured to be connectable to the merchandise information processing apparatus 1 via a communication cable, such as a USB cable.

The printer 10 can also be equipped with a user interface and can be configured to be able to operate independently of the merchandise information processing apparatus 1. Additionally, the printer 10 can be connected to a personal computer and can be configured to operate based on an instruction from the personal computer. Furthermore, while, in the above-described embodiments, the printer 10 is equipped with the notification unit 12, the printer 10 does not need to be equipped with the notification unit 12.

Furthermore, while, in the first and second embodiments, the merchandise information processing apparatus 1 is a POS terminal, the merchandise information processing apparatus 1 is not limited acting as a POS terminal. For example, the merchandise information processing apparatus 1 can be a stand-alone type cash register which does not have a network connection function.

Moreover, while, in the first and second embodiments, the printer 10 is installed at a POS terminal or a stand-alone type cash register, the apparatus at which the printer 10 is installed is not limited to these. For example, the apparatus at which the printer 10 is installed can be a financial information processing apparatus. The financial information processing apparatus can be an automated teller machine (ATM) in a bank. At this time, the merchandise information processing apparatus 1 can be reworded as a "financial information processing apparatus 1". Naturally, the apparatus at which the printer 10 is installed can be an apparatus other than the merchandise information processing apparatus and the financial information processing apparatus.

Furthermore, in the first and second embodiments, the merchandise information processing apparatus 1 or the financial information processing apparatus 1 has a configuration to which the printer 10 is fixed or in which the printer 10 is incorporated. However, the merchandise information processing apparatus 1 or the financial information processing apparatus 1 can be configured to be able to directly perform printing on the continuous sheet S without involving the printer 10. For example, the merchandise information processing apparatus 1 or the financial information processing apparatus 1 can include the communication interface 11, the notification unit 12, the control unit 13, the cutting unit 14, and the print unit 15. The control unit 13 can be used in common with a control device (for example, a processor) which controls each unit of the merchandise information processing apparatus 1 or the financial information processing apparatus 1. The merchandise information processing apparatus 1 or the financial information processing apparatus 1 can be regarded as the printer 10 itself.

Additionally, while, in the description of the first and second embodiments, the printer 10 is a receipt printer, the printer 10 is not limited to the receipt printer. For example, the printer 10 can be a label printer. At this time, a roll of paper PR to be stored in the printer 10 can be a roll of paper for label printing in which a label printing sheet is rolled. The label printing sheet is also a type of continuous sheet.

Furthermore, the printer 10 can be a printer other than a receipt printer or a label printer. For example, the printer 10 can be a printer that performs printing on a receipt or a bank statement or can be a journal printer that prints journal information. Information which the printer 10 prints on the continuous sheet S is not limited to transaction information, but can be different information.

Moreover, the continuous sheet S is not limited to a sheet drawn from a roll of paper. The continuous sheet S can be, for example, a continuous folded sheet.

Additionally, while, in the second embodiment, the printer 10 allows two rolls of paper to be loaded thereon, the printer 10 can be configured to allow more than two rolls of paper to be loaded thereon. In this case, the print engine 16 can have more than two sheet entrances. Then, a damper 17A or 17B can be arranged at each of the sheet entrances.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A print unit applicable to an apparatus having a printing function, the print unit comprising:

a print engine configured to perform printing on a portion of a continuous sheet drawn from a sheet roll, wherein the print engine includes:

a casing;

a sheet entrance from which the continuous sheet is guided into the casing;

a print head along a sheet travel path inside the casing; and a platen roller facing the print head across the sheet travel path; and a damper on an upstream side of the print engine in a sheet traveling direction and configured to adjust tension applied to the continuous sheet, wherein the damper includes:

a planar guide portion configured to guide the continuous sheet to the print engine, wherein an end portion of the planar guide portion on a downstream side in the sheet traveling direction is configured as a fixed end resting on the sheet entrance, and another end portion thereof on an upstream side opposite to the downstream side is configured as a swinging end and elastically biased toward the continuous sheet;

side guide portions at both ends of the planar guide portion in a sheet width direction, the side guide portions configured to correct a skew of the continuous sheet;

a swinging guide portion at an end of the planar guide portion in the sheet width direction, the swinging guide portion configured to limit a swinging range of the damper; and a shaft fixed to a frame, wherein the swinging guide portion has a slot engaged with the shaft.

2. The print unit according to claim 1, wherein the platen roller is configured to convey the continuous sheet drawn from the sheet roll.

3. The print unit according to claim 1, wherein an axial direction of the shaft is a direction parallel to the sheet width direction and perpendicular to the sheet traveling direction.

4. The print unit according to claim 3, wherein when the continuous sheet is not present on the planar guide portion, the shaft is located at a lower end of the swinging guide portion.

5. The print unit according to claim 3, wherein the damper further includes a cover which covers a gap between the shaft and a swinging end of the swinging guide portion.

6. The print unit according to claim 5, wherein the cover is formed as a part of the damper.

7. A printer comprising:

a holding portion to hold a sheet roll; and a print unit including a print engine configured to perform printing on a portion of the continuous sheet drawn from the sheet roll, a damper on an upstream side of the print engine in a sheet traveling direction and configured to adjust tension applied to the continuous sheet, wherein the print engine includes:

a casing;

a sheet entrance from which the continuous sheet is guided into the casing;

a print head along a sheet travel path inside the casing; and a platen roller facing the print head across the sheet travel path, and the damper includes:

a planar guide portion configured to guide the continuous sheet to the print engine, wherein an end portion of the planar guide portion on a downstream side in the sheet traveling direction is configured as a fixed end resting on the sheet entrance, and another end portion thereof on an upstream side opposite to the downstream side is configured as a swinging end and elastically biased toward the continuous sheet;

side guide portions at both ends of the planar guide portion in a sheet width direction, the side guide portions configured to correct a skew of the continuous sheet;

a swinging guide portion at an end of the planar guide portion in the sheet width direction, the swinging guide portion configured to limit a swinging range of the damper; and a shaft fixed to a frame, wherein the swinging guide portion has a slot engaged with the shaft.

8. The print unit according to claim 7, wherein the platen roller is configured to convey the continuous sheet drawn from the sheet roll.

9. The printer according to claim 7, wherein an axial direction of the shaft is a direction parallel to the sheet width direction and perpendicular to the sheet traveling direction.

10. The printer according to claim 9, wherein when the continuous sheet is not present on the planar guide portion, the shaft is located at a lower end of the swinging guide portion.

11. The printer according to claim 9, wherein the damper further includes a cover which covers a gap between the shaft and a swinging end of the swinging guide portion.

12. The printer according to claim 11, wherein the cover is formed as a part of the damper.

* * * * *